US009445638B2

(12) United States Patent
Wilson

(10) Patent No.: US 9,445,638 B2
(45) Date of Patent: Sep. 20, 2016

(54) MULTIFUNCTIONAL HAT ASSEMBLY

(71) Applicant: Alexander F Wilson, Wayne, PA (US)
(72) Inventor: Alexander F Wilson, Wayne, PA (US)

( * ) Notice: Subject to any disclaimer, the term of this patent is extended or adjusted under 35 U.S.C. 154(b) by 0 days.

(21) Appl. No.: 14/750,421

(22) Filed: Jun. 25, 2015

(65) Prior Publication Data

US 2016/0135532 A1 May 19, 2016

Related U.S. Application Data

(60) Provisional application No. 62/017,557, filed on Jun. 26, 2014.

(51) Int. Cl.

| | |
|---|---|
| ***A42B 1/00*** | (2006.01) |
| ***A41C 1/08*** | (2006.01) |
| ***A41B 11/00*** | (2006.01) |
| *A41D 20/00* | (2006.01) |

(52) U.S. Cl.

CPC ..... *A42B 1/006* (2013.01); *A41B 11/00* (2013.01)

(58) Field of Classification Search

CPC ..... A61H 2205/02; A41D 13/0015; A41D 1/08; A41D 20/00; A41B 11/00; A41B 1/08; A41B 11/002; A41B 11/14; A42B 1/006; A43C 15/168; A63B 2209/00

See application file for complete search history.

(56) References Cited

U.S. PATENT DOCUMENTS 3,825,952 A * 7/1974 Pershing ..... A42B 3/0473 2/205
4,017,906 A * 4/1977 Bochynsky ..... A42B 3/105 2/10
4,887,319 A * 12/1989 Daniels ..... A42B 3/105 2/410
5,062,163 A * 11/1991 Avey ..... A42B 1/067 2/410
5,467,510 A * 11/1995 Hartzell ..... A41B 11/002 24/104
6,032,294 A * 3/2000 Dean ..... A41B 11/002 2/239
6,067,659 A * 5/2000 Reichle ..... A41B 11/002 2/239
6,085,814 A * 7/2000 Choe ..... A63B 60/62 150/160
6,295,652 B1 * 10/2001 Mazur ..... A42B 3/0473 2/422
6,665,878 B1 * 12/2003 Way ..... A41D 3/02 2/84
6,862,749 B1 * 3/2005 Krause ..... A42B 3/105 2/422
6,990,694 B2 * 1/2006 Poole ..... A41B 11/002 2/239
7,043,942 B2 * 5/2006 Chapman ..... D04B 1/18 66/177
7,779,485 B2 * 8/2010 Gandy ..... A41D 3/00 2/202
2005/0115842 A1 * 6/2005 Stillwell ..... A42B 1/206 206/8
2007/0150091 A1 * 6/2007 Griffits ..... B07C 5/34 700/215
2009/0031582 A1 * 2/2009 Lu ..... A43C 11/006 36/10
2009/0188020 A1 * 7/2009 Beaumont ..... A41B 11/001 2/239
2014/0115749 A1 * 5/2014 Weinman ..... A41B 11/008 2/158

* cited by examiner

*Primary Examiner* — Bobby Muromoto, Jr.
(74) *Attorney, Agent, or Firm* — Gregory Finch

(57) ABSTRACT

A novel assembly for a hat comprised of removably coupled socks, fabric panels, gloves, and/or mittens. The present disclosure relates generally to a hat comprised of fully intact, yet selectively removable, socks, fabric panels, gloves, and/or mittens that are connected together by various disclosed methods. The socks, fabric panels, gloves, and/or mittens may be comprised of a variety of materials and styles, and can be coupled together through a number of disclosed combinations to form a winter hat that can be converted to one or more pairs of socks, fabric panels, gloves, and/or mittens.

20 Claims, 3 Drawing Sheets

MULTIFUNCTIONAL HAT ASSEMBLY

RELATED APPLICATIONS

This application claims the benefit of U.S. Provisional Application 62/017,557, filed Jun. 26, 2014, hereby incorporated by reference.

FIELD

The present disclosure relates to the field of outdoor gear and apparel, in particular, a novel assembly for multifunctional hat comprised of removably coupled socks, gloves, and/or mittens.

BACKGROUND

In the field of outdoor sports and activities, enthusiasts and hobbyist alike understand the importance of keeping extremities protected from the elements. In the case of cold weather outdoor sports and activities, it is important to keep hands, head, and feet warm and dry to prevent the harmful effects of excessive cold exposure. In the case of warm weather outdoor sports and activities, it is important to keep feet dry to prevent potentially harmful skin conditions. Outdoor enthusiasts and hobbyists such as hikers, climbers, campers, backpackers, and the like, are generally limited in the amount of gear they can carry on their person during these activities. As a result, these individuals are continuously looking for solutions that save space and provide multipurpose utility for related sporting garments and accessories.

Prior art solutions have tried to address these problems by incorporating pockets and other storage features into garments and accessories. No prior art solution has provided a meaningful multipurpose garment solution for outdoor enthusiasts and hobbyists. What is needed, therefore, is a solution that provides outdoor enthusiasts and hobbyists a multipurpose garment that can be worn on different body parts and reduce the overall number of garments needed to be stored in a bag or backpack during outdoor sports and activities.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is an apparatus comprising a plurality of socks removably coupled in a hat configuration, the plurality of socks comprising a first sock, a second sock, a third sock, and a fourth sock wherein all socks are removably coupled together to form a fully functional hat apparatus. Socks can be removed when needed to form the hat in a particular order and can then be used as feet warming devices.

Another object of the present disclosure is an apparatus comprising a plurality of socks removably coupled in a hat configuration, the plurality of socks comprising a first sock, a second sock, and fabric panel(s) wherein all socks and panel(s) are removably coupled together to form a fully functional hat apparatus. Socks can be removed when needed to form the hat in a particular order and can then be used as feet warming devices.

Another object of the present disclosure is an apparatus comprised of a plurality of combinations of socks, fabric panels, and gloves/mittens removably connected together to form a hat apparatus.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1A:
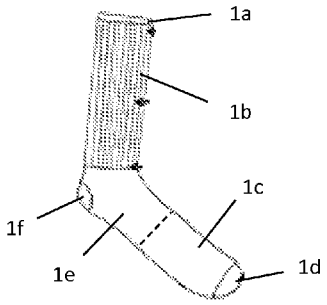
FIG. 1*a* is a perspective view of a sock that can be incorporated into embodiments of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

The present disclosure provides for a hat apparatus comprised of fully intact, yet selectively removable, socks, fabric panels, gloves and/or mittens that are connected together according to various disclosed methods. The socks, fabric panel, gloves, and/or mittens may be of a variety of materials and styles and can be coupled together through a number of disclosed combinations to form a hat apparatus that can be converted to one or more pairs of socks, gloves, and/or mittens. Most multi-day outdoor trip takers are well aware of the importance of dry socks, gloves, and/or mittens, especially during the colder months of the year. Inadequate hand or feet protection during exposure to cold can result in frostbite or other serious conditions. The present disclosure provides a hat apparatus assembly comprised of a plurality of removable socks that enables the wearer to use the assembly as a hat for head warmth, or selectively remove a desired combination of socks, gloves, and/or mittens from the hat for use on the hands or feet.

FIG. 1*a* is a perspective view of a sock. Socks are well-known in the art and need not be discussed at length here, aside from a discussion of the parts of a sock to aid in understanding how embodiments of the present invention are assembled. A sock is generally comprised of a cuff 1*a*, a leg 1*b*, a foot 1*c*, a toe 1*d*, an instep 1*e*, and a heel 1*f*. Embodiments of the present disclosure may be assembled from various styles of socks including crew socks, bare or ankle socks, tube socks, low cut socks, no-show socks, knee-high socks, over-the-knee socks, toe socks, and the like. Socks may be made from a variety of materials including cotton, wool, nylon, acrylic, polyester, olefins (such as polypropylene), spandex, silk, bamboo fiber, linen, cashmere, mohair, and blends thereof.

Figure 1:
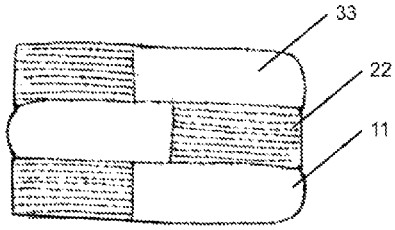
FIG. 1 is a perspective view of a configuration of socks 1, 2 and 3 before they are joined with sock 4 to form an embodiment of the present disclosure.

FIG. 1 is a perspective view of a configuration of socks 11, 22 and 33 before they are joined with sock 44 to form an embodiment of the present disclosure. According to an embodiment, socks 11, 22, and 33 are removably connected to form a portion of the hat apparatus. Alternative embodiments may be comprised of one or more socks, one or more gloves, and one or more mittens. Referring to FIG. 1, sock 11 and sock 22 may be arranged in opposite directions such that the cuff of sock 11 aligns with the toe of sock 22, and vice versa. Sock 33 may be arranged adjacent to sock 22 such that the cuff of sock 33 aligns with the toe of sock 22, and vice versa; and, may be arranged such that the heel of sock 33 is facing away from the leg of sock 22.

Figure 2:
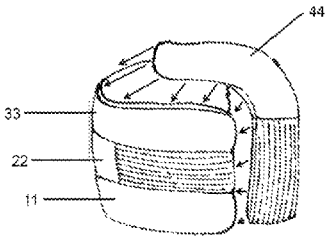
FIG. 2 is a perspective view of an incomplete assembly with an illustration of how assembly will be completed to form an embodiment of the present disclosure.

Referring now to FIG. 2, socks 11, 22, and 33 are shown to connect to sock 44 to form the apparatus. Sock 4 is removably connected along its three edges, not including the width wise edge of the leg portion, to the three edges of the three previously connected socks, not including the bottom lengthwise edge of the first sock that is not coupled to the second sock. This forms the apparatus.

According to an embodiment, socks 11, 22, 33, and 44 may be coupled by machine or hand stitching. Machine or hand stitching patterns that enable stitching to be readily removed by a user should be utilized to allow for selective removability of socks 11-44. Exemplary machine stitching patterns may include stitches contained within stitch class 100, stitch class 300, stitch class 400, stitch class 500, and stitch class 600. Examples of stitches contained within these classes include a chain stitch, lockstitch, straight stitch, zigzag stitch, stretch stitch, over lock, and cover stitch. Exemplary hand stitching patterns stitches contained within stitch class 200. Examples of these include, back tack, backstitch, basting stitch, blanket stitch, blanket stitch, blind stitch (or hemstitch), buttonhole stitch, chain stitch, cross-stitch, catch stitch (or flat/blind stitch), cross stich tack, darning stitch, embroidery stitch, hemming stitch, overcast stitch, pad stitch, pick stitch, running stitch, sailmakers stitch (or zoo stitching), slip stitch, tent stitch, topstitch, and whipstitch. Socks 11, 22, 33 and 44 may be coupled by fasteners such as hook and loop fasteners, zippers, tag fasteners, brads, magnets, buttons, snaps, and the like. According to an embodiment, the apparatus may have one or more pull-tabs coupled to a finishing stitch connecting socks 11, 22, 33, and 44. By pulling on the Pull Tab (shown in FIG. 16), the wearer may remove the machine or hand stitching described above such that the desired sock may be decoupled from the apparatus. Embodiments coupled by fasteners such as hook and loop fasteners, zippers, magnets, buttons, snaps, and the like may not need a pull tab if machine or hand stitching is not the primary method of coupling socks 11, 22, 33, and 44. It is anticipated that any combination of machine and hand stitching and fasteners such as hook and loop fasteners, zippers, magnets, buttons, snaps, and the like may be used to couple socks 11, 22, 33 and 44. One or more pull tabs may be used in combination with one or more of the above fasteners to remove socks from the apparatus.

Figure 3:
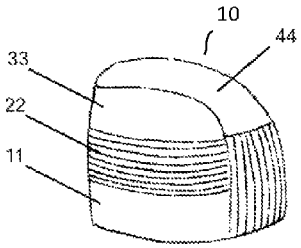
FIG. 3 is a right-side perspective view of an embodiment of the present disclosure.

FIG. 3 is a right-side perspective view of socks 11, 22, 33, and 44 coupled to form the apparatus.

Figure 4:
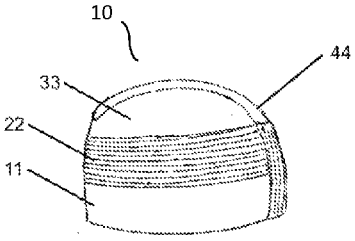
FIG. 4 is a right side view of an embodiment of the present disclosure.
Figure 5:
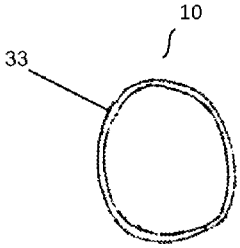
FIG. 5 is a bottom view of an embodiment of the present disclosure.
Figure 6:
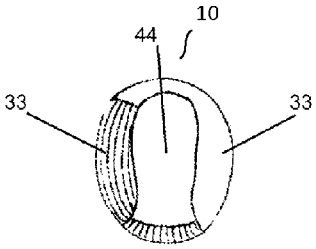
FIG. 6 is a top view of an embodiment of the present disclosure.
Figure 7:
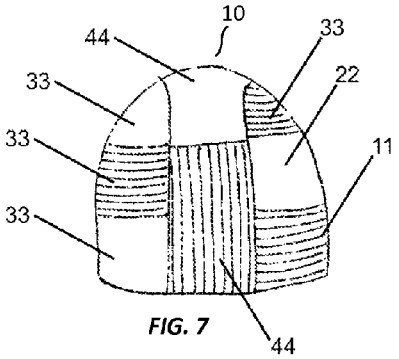
FIG. 7 is a front view of an embodiment of the present disclosure.
Figure 8:
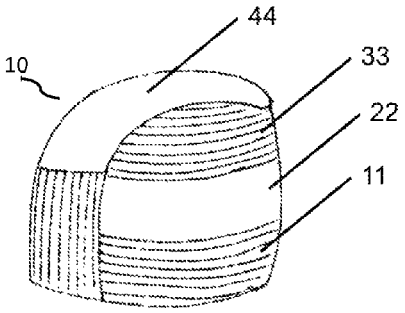
FIG. 8 is a left-side perspective view of the present disclosure.
Figure 9:
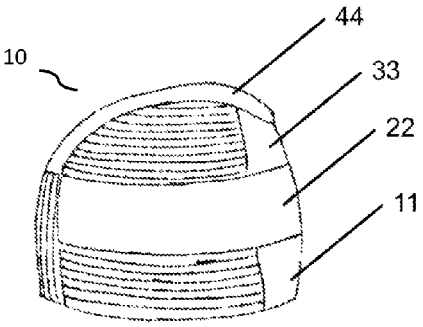
FIG. 9 is a left-side view of the present disclosure.
Figure 10:
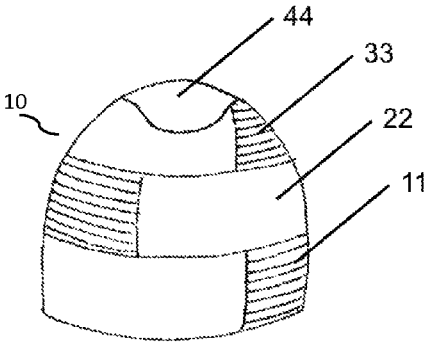
FIG. 10 is a back view of the present disclosure.

FIGS. 4-10 show varying perspective views of apparatus. According to an embodiment, FIG. 4 is a right side view of apparatus; FIG. 5 is a bottom view of apparatus; FIG. 6 is a top view of apparatus; FIG. 7 is a front perspective view of apparatus; FIG. 8 is a left side perspective view of apparatus; FIG. 9 is a left side view of the apparatus; FIG. 10 is a back view of the apparatus.

Figure 11:
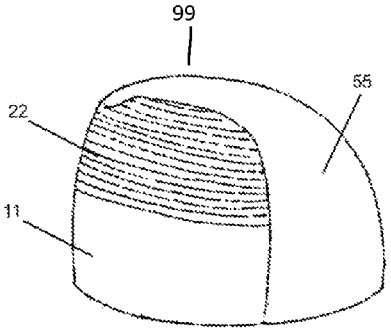
FIG. 11 is a left-side perspective view of the apparatus described in claim 7.

FIG. 11 shows a left side perspective view of the apparatus comprising a plurality of socks removably coupled together with a fabric panel 55 to form apparatus 99. The plurality of socks comprising a sock 11, sock 22, and fabric panel 55 wherein:

Sock 11 is removably coupled with sock 22 lengthwise along their respective edges. The socks are coupled in such a way that the edge of the toe portion of the sock 11 is connected to the edge of the leg portion of the sock 22 and the edge of the leg portion of the sock 11 is connected to the edge of the toe portion of sock 22 and, fabric panel 55 is removably connected along its three edges, not including the width wise edge of the bottom portion, to the three outside edges of the two previously connected socks 11 and 22, not including the bottom lengthwise edge of sock 11 that is not coupled to sock 22, forming the hat apparatus. Socks and Paneling may be connected together according to the machine or hand stitching patterns and attachment methods described above in FIG. 1.

Figure 12:
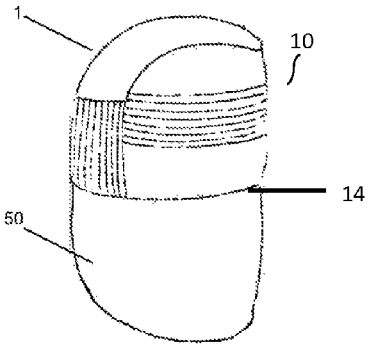
FIG. 12 is a right side perspective view of the present disclosure with its inner reversible liner pulled out from apparatus.

FIG. 12 is a left side perspective view showing reversible Liner 50 when it is removably coupled to base 14 by fasteners such as hook and loop fasteners, zippers, magnets, tag fasteners, brads, staples, buttons, snaps, and the like, or may be sewn to base 14. According to the machine or hand stitching patterns described above. Liner 50 may be made of any material described in FIG. 1*a*, as well as any water resistant material such as coated nylon. Liner may also be removably coupled together with sock 1-4 using the previous methods described.

Figure 13:
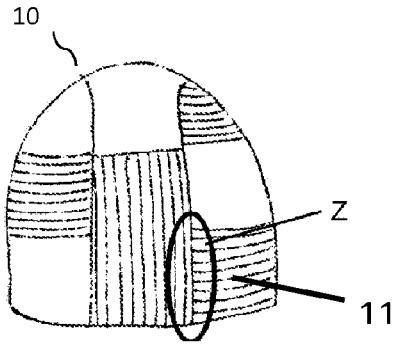
FIG. 13 is a front perspective view showing the locations of pockets according to an embodiment of the present disclosure.
Figure 14:
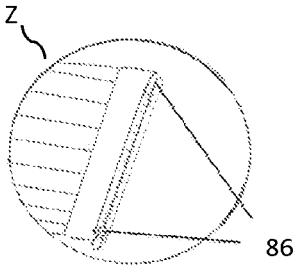
FIG. 14 is an exploded view of a pocket according to an embodiment of the present disclosure.

FIG. 13 is a front perspective view showing and exemplary location of a pocket location according to an embodiment of the present disclosure. According to an embodiment, hat 10 may have a plurality of pockets. According to FIGS. 13 and 14, a pocket Z is defined by an interior portion of sock 11; FIG. 14 is an exploded view of the pocket Z. According to an embodiment, a zipper 86 may be coupled to the cuff of sock 11 such that the pocket Z may be opened and closed to secure contents. Zipper 86 may be readily substituted with fasteners such as hook and loop, brads, magnets, buttons, snaps, and the like.

Figure 15:
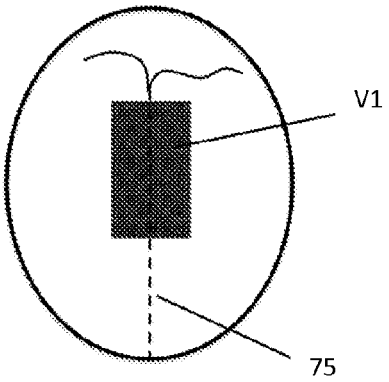
FIG. 15 shows a bottom portion of a pull tab system according to an embodiment of the present disclosure.

FIG. 15 shows the bottom portion of the pull tab system that is designed to keep the thread from unraveling until the pull tab is utilized. V1 represents the female Velcro rectangle that is sewn over by seam 75 at any seam that removably couples any of the socks, fabric paneling, and/or gloves/mittens together.

Figure 16:
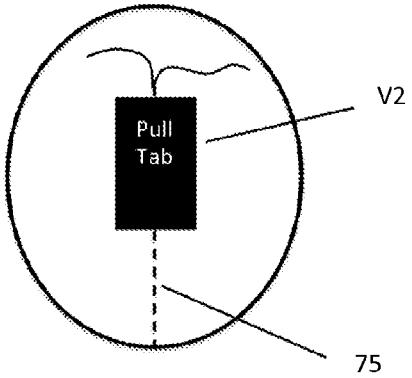
FIG. 16 shows the same pull tab system as illustrated in FIG. 15 with the addition of a male Velcro rectangle.

FIG. 16 shows the same pull tab system as illustrated in FIG. 15 with the addition of the male Velcro rectangle V2. V2 is connected to V1, locking the thread within the Velcro so it does not unravel without pulling the Pull Tab shown in FIG. 16.

Figure 17:
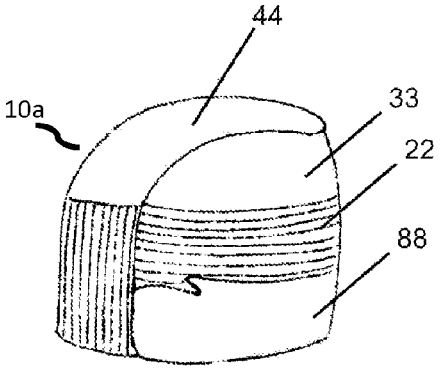
FIG. 17 is a right-side perspective view of the apparatus containing a glove/mitten in place of a sock.

Referring now to FIG. 17, according to an alternative embodiment hat 10*a* may include mitten 88. While FIG. 17 is shown with mitten 88, hat 10*a* may include one or more gloves, mittens, or other winter outerwear in addition to mitten 88, or as an alternative to mittens 88. Gloves, mittens, and other winter outerwear may be made from a variety of materials including cotton, wool, nylon, acrylic, polyester, olefins (such as polypropylene), spandex, silk, bamboo fiber, linen, cashmere, mohair, and blends thereof. These items are well known in the art and need not be discussed at length here. According to an embodiment, mitten 88 is removably coupled to an exterior portion of hat 10*a*. Hat 10, as discussed above, and hat 10*a* may be substantially identical in assembly and utility aside from the addition of mitten 6 on hat 10*a*. Mitten 88 may be coupled by machine or hand stitching as described above, or may be coupled by fasteners such as hook and loop fasteners, zippers, magnets, buttons, snaps, and the like. According to an embodiment, mitten 88 may have one or more pull tabs coupled to a finishing stitch connecting mitten 88 to hat 10*a*. By pulling on the pull tab, the wearer may remove the machine or hand stitching such that mitten 88 may be decoupled from hat 10*a*.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. An apparatus comprising:

a plurality of socks removably coupled in a hat configuration, the plurality of socks comprising a first sock, a second sock, and a third sock, wherein:

the first sock is removably coupled at a toe portion to a leg portion of the second sock, and removably coupled at a cuff portion to a leg portion of the third sock;

the second sock is removably coupled at a toe portion to a toe portion of the third sock; and, the second sock and the third sock are removably coupled along a length of the second sock and the third sock, beginning at the toe portion and continuing to a cuff portion.

2. The apparatus of claim 1 wherein the plurality of socks is removably coupled using a machine stitching pattern selected from the group consisting of: chain stitch, lockstitch, straight stitch, zigzag stitch, stretch stitch, over lock, and cover stitch.

3. The apparatus of claim 1 wherein the plurality of socks is removably coupled using a fastener selected from the group consisting of: hook and loop fasteners, zippers, magnets, buttons, and snaps.

4. The apparatus of claim 1 further comprising a fourth sock, the fourth sock being removably coupled the first sock, and being removably coupled at opposite ends to the leg portion of the second sock and the third sock.

5. The apparatus of claim 1 further comprising at least one mitten removably coupled to the plurality of socks.

6. The apparatus of claim 1 further comprising a fabric liner removable coupled to the plurality of socks.

7. The apparatus of claim 4 further comprising a fifth sock, the fifth sock being removably coupled to the fourth sock, and being removably coupled at a heel portion to the toe portion of the second sock and the toe portion of the third sock.

8. The apparatus of claim 6 wherein the fabric liner is made from a material selected from the group consisting of: fleece, knitted fabric, woven fabrics, non-woven fabrics, and performance fabrics.

9. An apparatus comprising:

a plurality of socks removably coupled in a hat configuration, the plurality of socks comprising a first sock, a second sock, a third sock, a fourth sock, and a fifth sock, wherein:

a toe portion of the first sock is removably coupled to a cuff portion of the second sock, and a cuff portion of the first sock is removably coupled to a toe portion of the second sock;

a toe portion of the third sock is removably coupled to the cuff portion of the second sock, and a cuff portion of the third sock is removably coupled to the toe portion of the second sock;

a cuff portion of the fourth sock is removably coupled to the toe portion of the first sock, and a toe portion of the fourth sock is removably coupled to a heel portion of the third sock;

a cuff portion of the fifth sock is removably coupled to the cuff portion of the first sock, and a toe portion of the fifth sock is removably coupled to the heel portion of the third sock; and, the fourth sock and the fifth sock are removably coupled to each other from the toe portion extending to the cuff portion.

10. The apparatus of claim 9 wherein the plurality of socks is removably coupled using a machine stitching pattern selected from the group consisting of: chain stitch, lockstitch, straight stitch, zigzag stitch, stretch stitch, over lock, and cover stitch.

11. The apparatus of claim 9 wherein the plurality of socks is removably coupled using a fastener selected from the group consisting of: hook and loop fasteners, zippers, magnets, buttons, and snaps.

12. The apparatus of claim 9 further comprising a liner removably coupled to the plurality of socks.

13. The apparatus of claim 9 further comprising at least one pocket coupled to the plurality of socks.

14. The apparatus of claim 9 further comprising at least one mitten removably coupled to the plurality of socks.

15. The apparatus of claim 9 further comprising a fabric liner removable coupled to the plurality of socks.

16. A hat assembly comprising:

at least two socks being removably coupled to form an interior portion and an exterior portion having a top and a sweatband; and, a liner removably coupled to the sweatband.

17. The apparatus of claim 16 wherein the plurality of socks is removably coupled using a stitching pattern selected from the group consisting of: chain stitch, lockstitch, straight stitch, zigzag stitch, stretch stitch, over lock, and cover stitch.

18. The apparatus of claim 16 wherein the plurality of socks is removably coupled using a fastener selected from the group consisting of: hook and loop fasteners, zippers, magnets, buttons, and snaps.

19. The apparatus of claim 16 further comprising at least one pocket.

20. The apparatus of claim 16 further comprising at least one mitten removably coupled to the plurality of socks.

* * * * *